US005304784A

United States Patent [19]

Tagashira et al.

[11] Patent Number: 5,304,784

[45] Date of Patent: Apr. 19, 1994

[54] HEATER FOR SHEET MATERIAL

[75] Inventors: Fumiaki Tagashira; Shigeo Ota; Shinya Yukawa; Shingo Ooyama, all of Kyoto, Japan

[73] Assignee: Rohm Co., Ltd., Kyoto, Japan

[21] Appl. No.: 995,888

[22] Filed: Dec. 23, 1992

[30] Foreign Application Priority Data

Dec. 28, 1991 [JP] Japan ..... 3-359321

[51] Int. Cl.[5] ..... H05B 3/16

[52] U.S. Cl. ..... 219/543; 219/216; 338/307

[58] Field of Search ..... 219/216, 469, 543; 338/306, 307, 308, 309; 355/285, 289, 290

[56] References Cited

U.S. PATENT DOCUMENTS 5,068,517 11/1991 Tsuyuki et al. ..... 219/216
5,153,411 10/1992 Nolebi ..... 219/216
5,162,634 11/1992 Kusaka et al. ..... 219/216

FOREIGN PATENT DOCUMENTS 57-101868 6/1982 Japan ..... 219/469
4-93971 3/1992 Japan ..... 355/290

*Primary Examiner*—Bruce A. Reynolds
*Assistant Examiner*—Gregory L. Mills
*Attorney, Agent, or Firm*—William H. Eilberg

[57] ABSTRACT

A heater for heating a moving sheet material by contact therewith is used, for example, in electrophotographic apparatus for fixing toner to printing paper. The heater comprises an insulating substrate formed with a striplike heating element on its upper surface, and a support plate for supporting the substrate. A higher heat preserving property is given to the opposite end portions of the heating element than to a longitudinal intermediate portion thereof to thereby compensate for a temperature reduction at the element end portions and make the heating element uniform in temperature over the entire length thereof.

11 Claims, 8 Drawing Sheets

HEATER FOR SHEET MATERIAL

BACKGROUND OF THE INVENTION

1. Field of the Invention

The present invention relates to heaters for sheer materials, and more particularly to heaters especially suited for use in the electrophotographic process for fixing toner as transferred from a photosensitive drum onto paper.

2. Description of the Prior Art

In the so-called electrophotographic process, toner is transferred from a photosensitive drum to paper, then fused by heating with a heater and thereby fixed to the paper. The electrophorographic process has found wide use in dry copying machines, laser printers, LED printers, printing units of facsimile systems, etc.

To permit use of a compacted lightweight fixing unit in the electrophotographic process and to render the unit heatable to the operating temperature in a shortened period of time, the fixing heater, which is traditionally in the form of a tube having halogen lamp inserted therein, is replaced in some cases by a heater which comprises a strip of heating element provided on an insulating substrate. Such a hearer is disclosed, for example, in the specification of U.S. Pat. No. 5,068,517.

The disclosed heater can be produced by a simple process wherein a silver-palladium paste or the like is printed in a strip form on an insulating substrate of ceramic and then baked to form a heating resistor, is generally thin, can be heated to the toner fixing temperature instantaneously after passing a current between both ends of the resistor, and therefore has the advantage of not only providing a compact, light-weight and inexpensive fixing unit for the electrophotographic process but also necessitating little or no waiting time after the passage of current.

As shown in FIG. 8, conventional heaters of this type comprise an insulating substrate a in the form of an elongated rectangular plate, a striplike heating element b formed on the upper surface of the substrate from a resistor paste by printing and baking and having a predetermined length longitudinally of the substrate, and conductor electrodes c, c partially lapping over the respective opposite ends of the heating element b and prepared from a silver paste or like conductor paste by printing and baking.

With this structure, the heat produced by the heating element b escapes from both ends thereof to the outside through the electrodes c, c and power supply wires (not shown) connected thereto, with the result that the temperature distribution of the heating element b with respect to the lengthwise direction thereof involves a lower temperature at its opposite ends than at the intermediate portion therebetween as seen in FIG. 9. When the effective length L of the heating element b has such a reduced temperature at its opposite ends, there arises the problem that the toner becomes fixed insufficiently at opposite ends of the paper used or that fixing irregularities occur with respect to the width of the paper.

This problem will be readily overcome by sufficiently increasing the length of the heating element b relative to the effective length L of heat production and using only the uniform temperature range L' of the temperature distribution shown in FIG. 9 as an effective range of heat production.

However, the heating element so designed can not always be employed because the heating element then makes the heater itself elongated or because the fixing unit for the electrophotographic process must have a larger size to incorporate the elongated heater.

The specification of the above-mentioned U.S. Pat. No. 5,068,517 proposes another idea for correcting the temperature reduction at the heating element opposite ends due to the escape of heat from the end electrode portions, i.e., a striplike heating element b having a smaller width at its opposite ends than at the intermediate portion thereof as shown in FIG. 10. With the invention disclosed in this publiection, the opposite ends of smaller width have a greater resistance value than at the intermediate portion of large width, so that when a given current is passed through the heating element b, the rise in temperature is greater toward the opposite ends of greater resistance value. This compensates for the escape of heat from the end electrodes c, c to give a uniform temperature distribution to the heating element b in its entirety.

Nevertheless, since the striplike heating element b of the above structure locally has at its opposite ends a width smaller than the standard width of its intermediate portion, the heating element itself is inevitably weak thermally at the end portions, subjected to a marked temperature difference at the boundary between the electrode c and each element end, and liable to break owing to a thermal stress at the boundary.

Thus, it is difficult to achieve a satisfactory result in respect of the strength or life of the heating element b by the method shown in FIG. 10 of obtaining a uniform temperature distribution by decreasing the width of the heating element b at both ends thereof to give an increased resistance value.

SUMMARY OF THE INVENTION

Accordingly, an object of the present invention is to provide a sheet material heater which is made uniform in the temperature distribution of its heating element longitudinally thereof without entailing the likelihood of a break at the boundary between the heating element and each electrode.

To fulfill the above object, the present invention provides a heater which comprises an insulating substrate formed with a striplike heating element on an upper surface thereof, and a support plate supporting the insulating substrate, the thermal conductivity between the insulating substrate and the support plate being so determined as to be lower at positions corresponding respectively to longitudinal opposite end portions of the heating element than at a position corresponding to a longitudinal intermediate portion of the heating element.

According to a preferred embodiment of the invention, the thermal conductivity between the support plate and the insulating substrate is determined by interposing therebetween a substance having a predetermined thermal conductivity only at the position corresponding to the longitudinal intermediate portion of the heating element, and interposing no substance at the positions corresponding respectively to the longitudinal opposite end portions of the heating element.

According to another embodiment of the invention, the thermal conductivity between the insulating substrate and the support plate is determined by interposing therebetween a first substance having a predetermined thermal conductivity at the position corresponding to the longitudinal intermediate portion of the heating element, and a second substance having a lower thermal conductivity than the first substance at the positions corresponding respectively to the longitudinal opposite end portions of the heating element.

The invention further provides as another embodiment a heater which comprises an insulating substrate formed with a striplike heating element on an upper surface thereof with a glass glaze layer provided therebetween, the glass glaze layer including a first region beneath a longitudinal intermediate portion of the heating element and a second region beneath longitudinal opposite end portions of the heating element, the second region being lower than the first region in thermal conductivity.

The invention further provides as another embodiment a heater which comprises a striplike heating element formed on an insulating substrate, with a glass glaze layer provided therebetween, the glass glaze layer having a smaller width over a predetermined length range corresponding to each of longitudinal opposite end portions of the heating element than in the other range.

The heat produced by the heating element on the insulating substrate not only escapes to the outside through the electrodes connected to the respective end portions of the heating element but also escapes from the rear surface of the substrate to the support plate supporting the substrate. With the present invention, the thermal conductivity between the substrate and the support plate is made lower at the positions corresponding to the respective longitudinal end portions of the heating element than at the position corresponding to the longitudinal intermediate portion thereof. Thus, the heat produced by the opposite end portions of the element is less likely to escape to the support plate than the heat produced by the element intermediate portion. In other words, the heating element end portions have higher ability to preserve heat than the intermediate portion.

Accordingly, the heat preserving property of the striplike heating element thus enhanced at its opposite end portions compensates for a temperature reduction due to the escape of heat through the electrodes, giving a uniform temperature distribution to the heating element over the entire length thereof.

With the present invention, the heating element itself can be made uniform in structure over the entire length thereof without decreasing the width of the heating element itself locally, so that unlike the method shown in FIG. 10 of ensuring a uniform temperature distribution by reducing the width of the opposite ends, the boundary between the heating element and each electrode is less susceptible to a break, permitting the heating element or heater to retain a higher strength or longer life.

The glass glaze layer to be formed between the insulating substrate and the striplike heating element is made different in heat preserving property between the portions thereof corresponding to the opposite end portions of the element and the portion thereof corresponding to the intermediate portion of the element.

More specifically, the glass glaze layer is made lower in thermal conductivity beneath the longitudinal end portions of the heating element than beneath the longitudinal intermediate portion of the element, whereby a higher heat preserving property is given to the heating element end portions than to the element intermediate portion to compensate for the escape of heat through the electrodes and render the heating element uniform in temperature distribution over the entire length thereof. The width of the heating element is not decreased locally in this case either. This obviates the problem encounterd with the structure of FIG. 10 that the heating element will be thermally embrittled and become susceptible to breakage at the boundary adjoining each electrode.

When the glass glaze layer is reduced in width at the portions thereof corresponding to the opposite end portions of the heating element, the reduction in the width of the glass glaze layer decreases the amount of heat to be transferred from the heating element to the insulating substrate. This is equivalent to the heat preserving property of the heating element as rendered higher at its end portions than at its intermediate portion, whereby the escape of heat from the electrodes can be compensated for to make the temperature distribution of the heating element uniform over the entire length thereof Other objects and features of the present invention will become more apparent from the following detailed description with reference to the drawings.

DESCRIPTION OF THE PREFERRED EMBODIMENTS

Preferred embodiments of the present invention will be described below in detail with reference to the drawings concerned.

Figure 1:
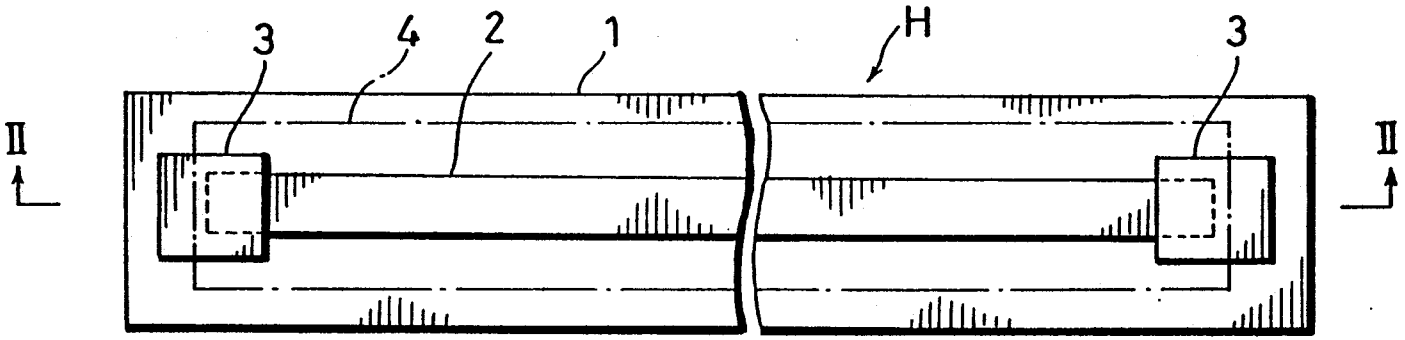
FIG. 1 is a plan view showing a first embodiment of heater of the invention.
Figure 2:
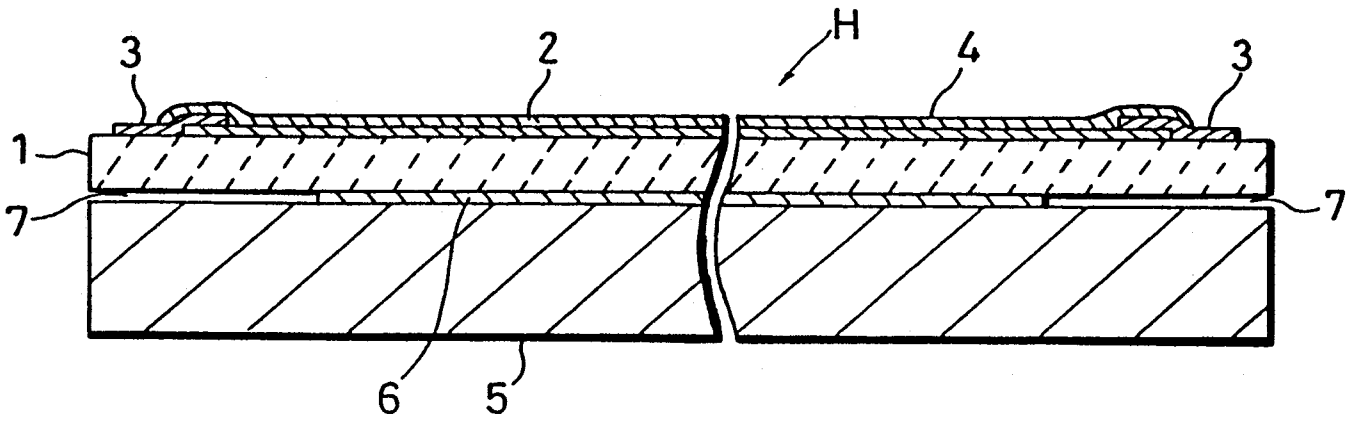
FIG. 2 is a view in section taken along the line II—II in FIG. 1.

FIGS. 1 and 2 show a first embodiment of sheet material heater H of the invention. A striplike heating element 2 having a predetermined width is formed on the upper surface of an insulating substrate 1 in the form of an elongated rectangle when seen from above by printing and baking a silver-palladium paste or like resistor paste. Electrodes 3, 3 are formed on and partially lapped over the respective opposite end portions of the heating element 2 by printing and baking a conductor paste such as silver paste. A protective glass coating 4 is provided over the heating element 2 and the electrodes 3, 3 lapped over the end portions thereof. The electrodes 3, 3 are partly left exposed without being covered with the glass coating 4, and the exposed portions serve as terminal portions connected to power supply wires (not shown) by suitable means, e.g., by high-temperature soldering.

The insulating substrate 1 can be prepared, for example, from an alumina-ceramic plate. Although not shown in FIG. 2, there is a case wherein the insulating substrate 1 has a glass glaze layer formed before the heating element 2 is formed.

As shown in FIG. 2, the insulating substrate 1 is mounted on a support plate 5 as superposed thereon. The support plate 5 suitably dissipates heat from the substrate 1, serves as a structure for reinforcing and mounting the substrate 1 and is prepared from a material having a high thermal conductivity such as aluminum. A substance 6 having a high thermal conductivity, such as a silicone compound, is usually interposed between the support plate 5 and the insulating substrate 1. With the present embodiment, the interposed substance 6 is provided only below a predetermined region of longitudinal intermediate portion of the heating element 2, but no interposed substance is disposed at positions corresponding to the opposite end portions of the heating element 2 as seen in FIG. 2. Accordingly, air serving as a heat-insulating material is present between the substrate 1 and the support plate 5 at these positions corresponding to the element end portions.

Figure 3:
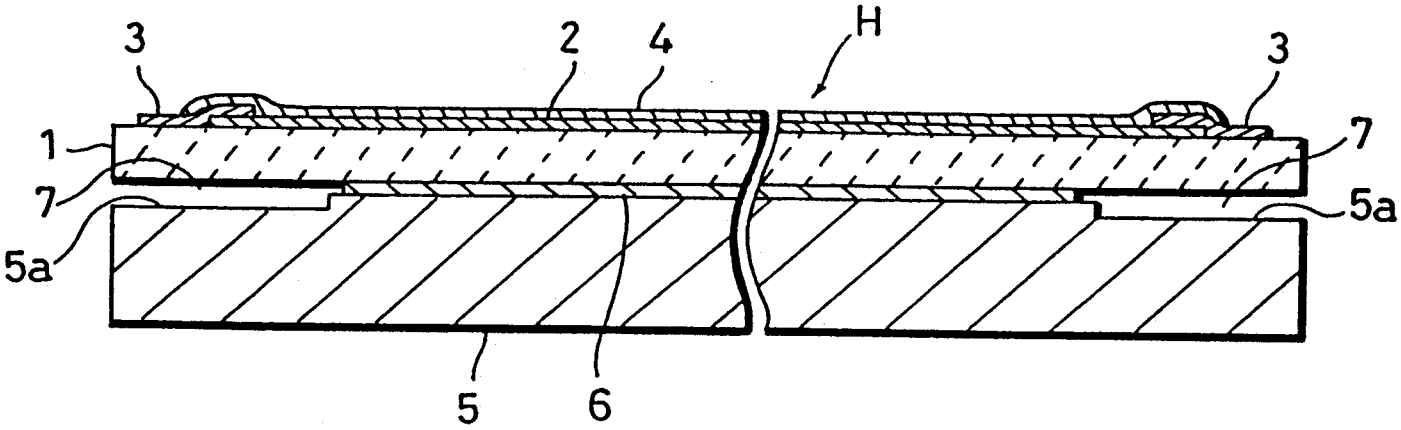
FIG. 3 is a sectional view showing a modification of the first embodiment.

With the embodiment shown in FIG. 2, the support plate 5 has a planar upper surface over the entire length thereof, whereas stepped portions 5*a*, 5*a* can be formed in the upper surface of the support plate 5 at its respective lengthwise ends to ensure that a heat-insulating air layer 7 will be formed between the upper surface of each stepped portion 5*a* and the rear surface of the substrate 1 as shown in FIG. 3.

When a current is passed between the electrodes 3, 3 to drive the heating element 2 for heating, the heat produced partly escapes from the opposite end portions of the element 2 to the outside through the electrodes 3, 3 and partly escapes to the support plate 5 through the thermally conductive interposed substance 6.

According to the present invention, the region from which heat escapes from the heating element to the support plate 5 through the interposed substance 6 is restricted only to the longitudinal intermediate portion of the element 2 to limit the escape of heat to the support plate 5 through the positions corresponding to the respective longitudinal end portions of the element 2 and to thereby prevent a temperature reduction at the element end portions due to the escape of heat through the electrodes 3, 3.

In other words, the heat preserving property of the heating element 2 is made higher at the longitudinal end portions than at the longitudinal intermediate portion to thereby compensate for the temperature reduction due to the escape of heat through the electrodes 3, 3.

This makes the longitudinal temperature distribution of the heating element 2 uniform without increasing the entire length of the element 2 more than is needed to effectively obviate fixing irregularities although heat escapes from the opposite end portions of the element 2 to the outside through the electrodes 3, 3.

Figure 4:
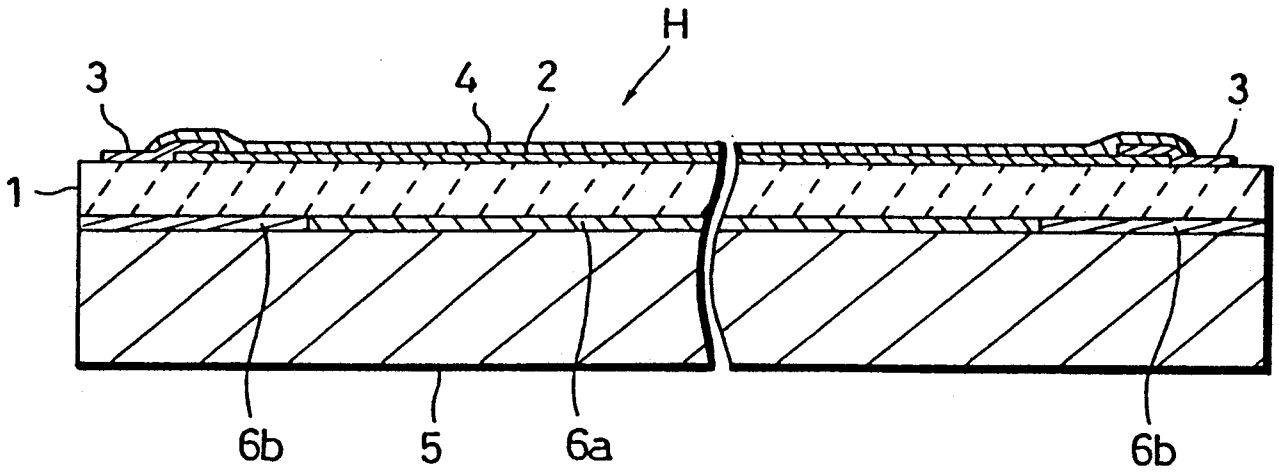
FIG. 4 is a sectional view of a second embodiment of heater of the invention.

FIG. 4 is a sectional view showing a second embodiment of heater H of the invention. In a plan view, this embodiment can be of the same form as is shown in FIG. 1.

With the second embodiment, the substance 6 to be interposed between a support plate 5 and an insulating substrate 1 is made different in thermal conductivity between the portion thereof corresponding to a longitudinal intermediate portion of a heating element 2 and the portions thereof corresponding respectively to longitudinal opposite end portions of the heating element 2. Stated more specifically, disposed at the position corresponding to the longitudinal intermediate portion of the heating element 2 is a first interposed substance 6*a* which, like the substance 6 used in the embodiment of FIG. 2, is a thermally conductive substance such as a silicone compound. A second interposed substance 6*b*, which is disposed at the positions corresponding to the respective end portions of the heating element 2, is a substance having a lower thermal conductivity than the first interposed substance 6*a*, such as resin or plastics in the form of a tape.

It will be readily understood that the object of the invention can be achieved also by the present embodiment like the first embodiment shown in FIGS. 1 to 3. More specifically, the amount of heat, per unit length, escaping to the support plate 5 through the second interposed substance 6*b* is smaller than the amount of heat, per unit length, escaping through the first interposed substance 6*a* below the intermediate portion of the heating element 2. This gives an enhanced heat preserving property to the opposite end portions of the heating element 2 to thereby compensate for a drop in temperature due to the escape of heat from the element end portions to the outside through the electrodes 3, 3, consequently making the temperature distribution of the heating element 2 uniform over the entire length thereof.

Figure 5:
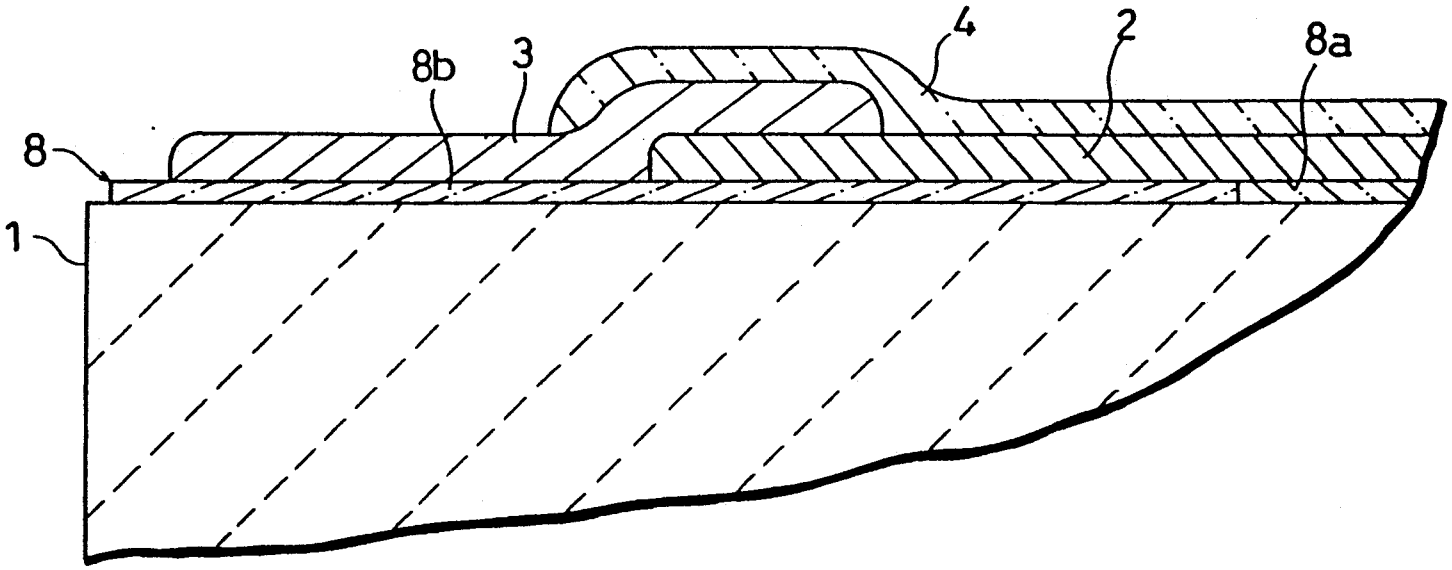
FIG. 5 is a sectional view of a third embodiment of heater of the invention.

FIG. 5 is a sectional view showing a third embodiment of heater H of the present invention. In a plan view, this embodiment can be of the same form as the first embodiment of FIG. 1.

With the third embodiment, a glass glaze layer 8 is provided between the upper surface of an insulating substrate 1 and a heating element 2, and divided into a first region 8*a* corresponding to a longitudinal intermediate portion of the heating element 2 and a second region 8*b* corresponding to each of longitudinal opposite end portions of the element 2. The second region 8*b* of the glass glaze layer is lower than the first region 8*a* thereof in thermal conductivity. This gives a higher heat preserving property to the end portions of the heating element 2 than to the intermediate portion thereof, thereby compensating for a reduction in temperature due to the escape of heat from the end portions of the heating element 2 through the electrodes 3, 3 and rendering the temperature distribution of the element 2 uniform over the entire length thereof.

Figure 6:
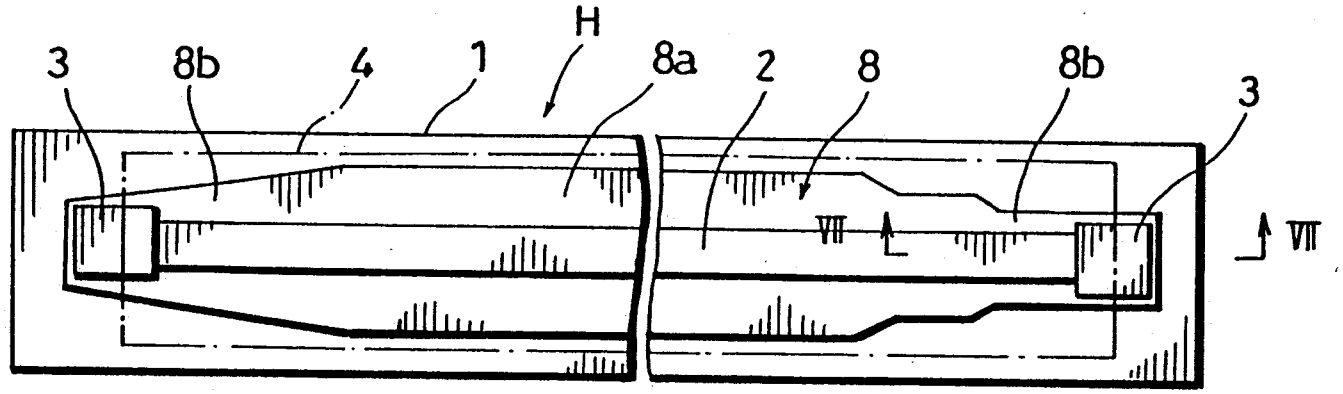
FIG. 6 is a plan view of a fourth embodiment of heater of the invention.
Figure 7:
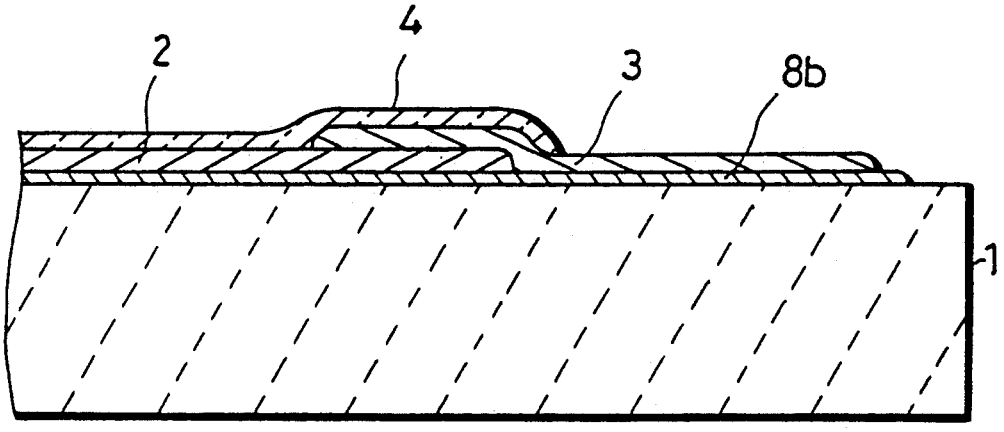
FIG. 7 is a view in section taken along the line VII—VII in FIG. 6.
Figure 8:
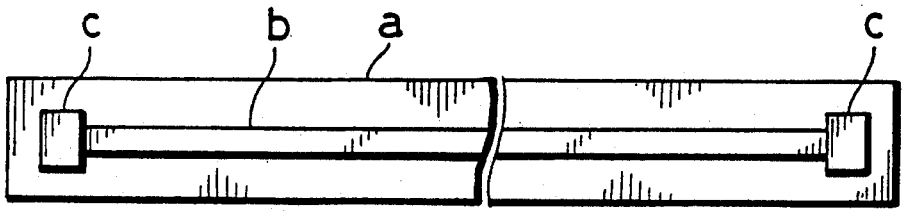
Fig. 8 Prior Art
FIG. 8 is a plan view showing a conventional common heater of the same type.
Figure 9:
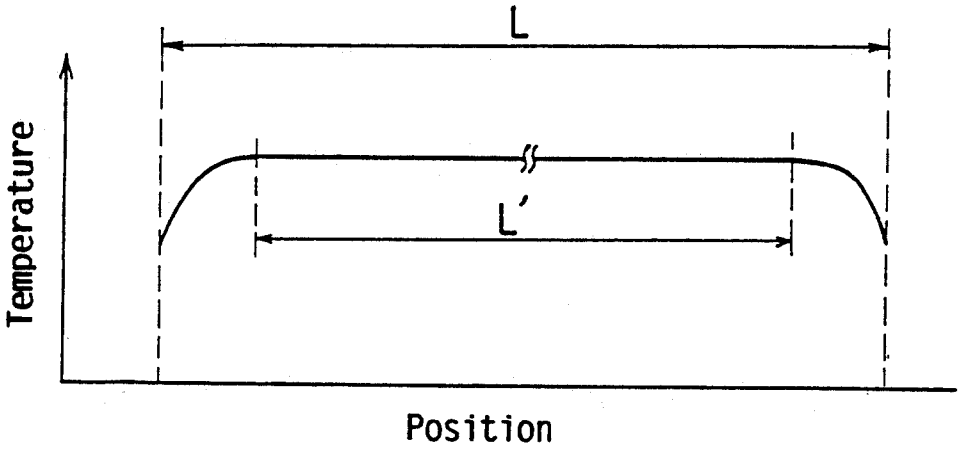
Fig. 9 Prior Art
FIG. 9 is a temperature distribution diagram of the heater shown in FIG. 8.
Figure 10:
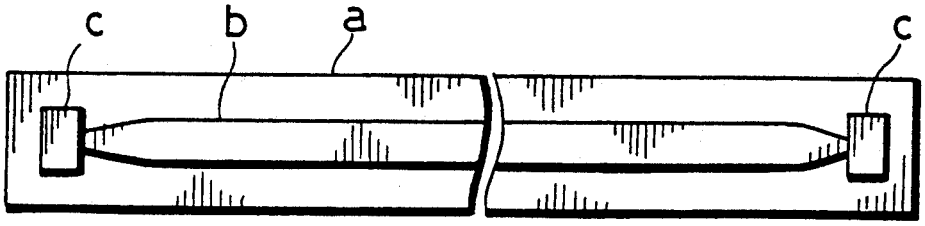
Fig. 10 Prior Art
FIG. 10 is a plan view showing another conventional heater of the same type.

FIG. 6 is a plan view showing a fourth embodiment of the present invention, and FIG. 7 is a view in section taken along the line VII—VII in FIG. 6.

With this embodiment, a glass glaze layer 8, which is formed between the upper surface of an insulating substrate 1 and a heating element 2, has a width which is made smaller over a predetermined length range corresponding to each of longitudinal opposite end portions of the heating element 2 than in the other range. The reduced width can be given by tapering the glaze layer 8 toward its extremity as shown in the left-hand side of FIG. 6, or by decreasing the width of the layer 8 stepwise as it extends toward the extremity as shown in the right-hand side of FIG. 6.

In either case, the amount of heat escaping from the heating element 2 to the insulating substrate 1 is smaller through the glaze layer end portion 8*b* of reduced width than through the intermediate portion 8*a* which is not reduced in width, consequently giving a higher heat preserving property to the end portion of the heating element 2. Accordingly, the heat preserving property thus enhanced compensates for the dissipation of heat from the opposite end portions of the heating element 2 to make the temperature distribution of the heating element 2 uniform over the entire length thereof.

Although heat is allowed to escape from the opposite ends of the striplike heating element 2 through the electrodes 3, 3 in the case of the sheet material heaters H of the invention described, a higher heat preserving property is given to the opposite end portions of the heating element 2 than to the intermediate portion thereof by dividing the glass glaze layer 8 into regions of different heat preserving properties, or by making the thermal conductivity between the insulating substrate 1 and the support plate 5 supporting the substrate different for divided regions as arranged longitudinally of the heating element 2. Since the temperature reduction at the opposite end portions of the heating element 2 can be compensated for in this way, the element 2 can be assured of a uniform temperature distribution over the entire length thereof without altering the width of the heating element 2 itself from portion to portion longitudinally of the element. As a result, the heating element 2 can be effectively precluded from breaking especially at its end portion close to the joint between the element and the electrode owing to a thermal stress. The heater H therefore retains its strength and is serviceable for a prolonged period of time.

Of course, the scope of the present invention is not limited to the foregoing embodiments. For example, the heating element 2, which is prepared from a silver-palladium paste by printing and baking, can alternatively be formed by a ruthenium oxide paste.

Furthermore, the support plate 5 is prepared from a suitable material as selected from among aluminum, sheet metal, resin, etc.

Apparent alterations within the scope of principle as set forth in the appended claims are all included within the scope of the invention.

We claim:

1. A heater for heating a moving sheet material by contact therewith comprising:

an electrically insulating substrate having a surface formed with a striplike heating element;

a support plate supporting the insulating substrate;

a first filled intervening layer formed between the substrate and the support plate at a longitudinally intermediate portion of the heating element; and a second intervening layer formed between the substrate and the support plate at each of longitudinally opposite end portions of the heating element;

wherein the second intervening layer has a lower thermal conductivity than the first intervening layer.

2. The heater according to claim 1, wherein the second intervening layer is a non-closed air layer.

3. The heater according to claim 1, wherein the second intervening layer is equal in thickness to the first intervening layer.

4. The heater according to claim 1, wherein the second intervening layer is larger in thickness than the first intervening layer.

5. The heater according to claim 4, wherein the support plate has a stepped end portion at the second intervening layer.

6. The heater according to claim 1, wherein the first intervening layer is made of a silicone compound.

7. The heater according to claim 1, wherein the second intervening layer is a filled layer.

8. The heater according to claim 1, wherein the substrate is made of alumina.

9. The heater according to claim 1, wherein the heating element is formed by printing and baking a silver-palladium paste.

10. The heater according to claim 1, wherein the heating element is formed by printing and baking a ruthenium oxide paste.

11. The heater according to claim 1, wherein the support plate is made of aluminum.

* * * * *